US006729605B2

(12) United States Patent
Brackman et al.

(10) Patent No.: US 6,729,605 B2
(45) Date of Patent: May 4, 2004

(54) CABLE WINCH HOISTING DEVICE FOR STAGES

(75) Inventors: Reind Brackman, Weesp (NL); Theodor Helmle, Ellwangen (DE); Roland Koblinger, Backnang (DE); Servaas Tullemans, Amsterdam (NL)

(73) Assignees: Alpha Getriebebau GmbH, Igersheim (DE); Beo Brackman Electronics & Optics B.V., Weesp (NL)

( * ) Notice: Subject to any disclaimer, the term of this patent is extended or adjusted under 35 U.S.C. 154(b) by 0 days.

(21) Appl. No.: 10/102,198

(22) Filed: Mar. 20, 2002

(65) Prior Publication Data

US 2002/0171071 A1 Nov. 21, 2002

(30) Foreign Application Priority Data

Mar. 21, 2001 (DE) ..... 101 13 895

(51) Int. Cl.[7] ..... B66D 1/12

(52) U.S. Cl. ..... 254/292; 254/283; 254/286; 254/288; 472/78

(58) Field of Search ..... 254/283, 286, 254/288, 292; 472/78

(56) References Cited

U.S. PATENT DOCUMENTS 1,810,890 A * 6/1931 Allen
2,942,879 A * 6/1960 Izenour ..... 272/22
3,986,703 A * 10/1976 Brett et al. ..... 254/173 R
4,096,404 A * 6/1978 Sukhanov et al. ..... 310/83
4,303,237 A * 12/1981 Hoffend et al. ..... 272/22
4,324,386 A * 4/1982 Gagnon et al. ..... 254/288
5,106,057 A * 4/1992 Feller et al. ..... 254/292
6,385,493 B1 * 5/2002 Hennessey et al. ..... 700/65

FOREIGN PATENT DOCUMENTS

| | | |
|---|---|---|
| DE | 87 16 506.6 | 4/1988 |
| DE | 34 29 876 | 11/1993 |
| DE | 197 33 299 | 2/1999 |
| DE | 298 22 894 | 6/1999 |
| DE | 197 52 003 | 10/1999 |
| DE | 695 09 654 | 10/1999 |

* cited by examiner

*Primary Examiner*—Thomas J. Brahan
(74) *Attorney, Agent, or Firm*—Collard & Roe, PLC.

(57) ABSTRACT

A cable winch hoisting device for theatrical stages, whereby a plurality of elongated, rod-like holding girders are suspended on cables, and these holding girders are adjustable in height by varying the free cable length between the cable suspension and the holding girder, which determines the position of the respective holding girder. The holding girders are adjustable in height between two end positions without any mutual interference in the clearance spaces which do not overlap with one another and are provided for the holding girders. At least two cables which are uniformly adjustable by the same cable-operating device act on the holding girders and are distributed over the length of the girders. The cable-operating devices are each electrically driven cable drums. The cables acting on the same holding girder can be wound up side by side onto the cable drum of the respective cable-operating device with the same change in free cable length, which determines the position of the holding girder. The device is designed to be especially space-saving and functionally versatile with a simple structural design.

14 Claims, 3 Drawing Sheets

CABLE WINCH HOISTING DEVICE FOR STAGES

BACKGROUND OF THE INVENTION

Field of the Invention

This invention relates to a cable winch hoisting device for theatrical stages. The invention solves the problem of designing such a device so that it has a simple, space-saving construction and can be operated in an abundant variety of functions.

SUMMARY OF THE INVENTION

The invention comprises a winch hoisting device for theatrical stages, whereby a plurality of elongated, rod-like holding girders are suspended on cables, and these holding girders are adjustable in height by varying the free cable length between the cable suspension and the holding girder, which determines the position of the respective holding girder. The holding girders are adjustable in height between two end positions without any mutual interference in the clearance spaces which do not overlap with one another and are provided for the holding girders. At least two cables which are uniformly adjustable by the same cable-operating device act on the holding girders and are distributed over the length of the girders. The cable-operating devices are each electrically driven cable drums. The cables acting on the same holding girder can be wound up side by side onto the cable drum of the respective cable-operating device with the same change in free cable length, which determines the position of the holding girder. The device is designed to be especially space-saving and functionally versatile with a simple structural design.

The invention is based on the general idea of using drive devices with an especially shallow design in cable-operating devices, and having these drive devices encompassed as completely as possible by a respective bowl-shaped cable drum. The width of the cable-operating devices in the axial direction of the drums is determined essentially by the width of the drums. In this way, the multiple cables required for a holding girder run in close proximity, where each drum of a cable-operating device guides all the cables belonging to one hoisting girder.

In the case of holding girders in close proximity to one another to be mounted on the stage space, the cable-operating devices according to this invention can be designed in rows situated one above the other with cables guided in planes one above the other. With the arrangement in two rows lying one above the other, the cable-operating devices can be arranged with an offset with a mutual gap. The cables from the cable-operating devices in the lower row respectively may be passed beneath the cable-operating devices and their fastenings in the row above that with no problem. The cables may also be guided in different planes after horizontal deflection at the upper end of the stage space.

The cable-guiding drums of the cable-operating devices may preferably be made of plastic.

Mechanically operable means for emergency operation of the brakes of these operating devices can project outward through the gaps between cable-operating devices situated side by side.

The respective drive device of the cable-operating devices may be a synchronous motor which is energized by a permanent magnet and whose torque is transmitted via a gear to the cable drum. The gear is expediently designed as a planetary gear.

Each drive device may be equipped with an independent, integrated frequency regulator. However, an especially advantageous design is one in which several drive devices are operated with the same frequency regulator and a circuit using a bus system, for example, is provided for this purpose.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
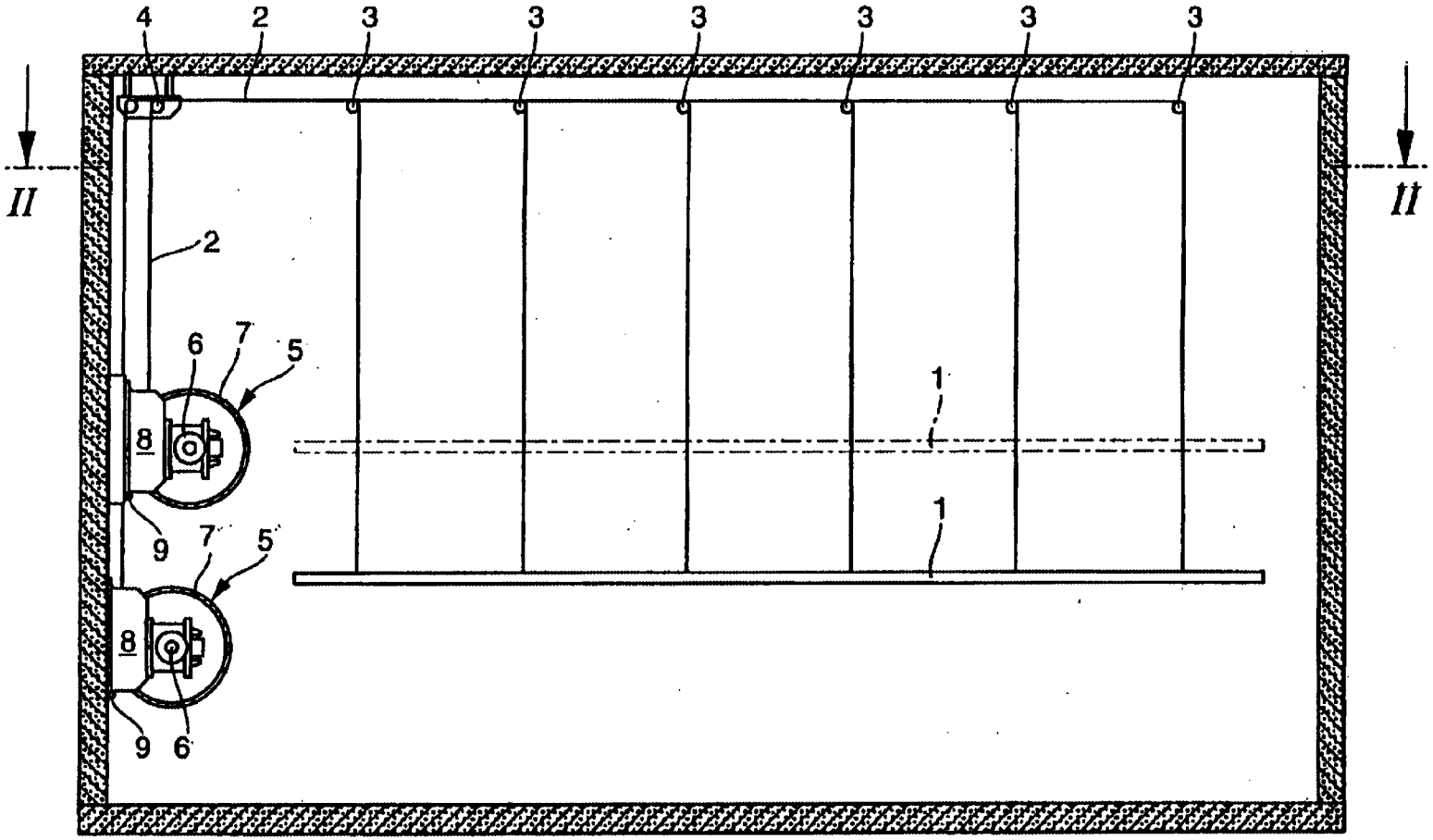
FIG. 1 shows a section through a stage space with a sectional view of cable drums of the cable-operating devices.
Figure 2:
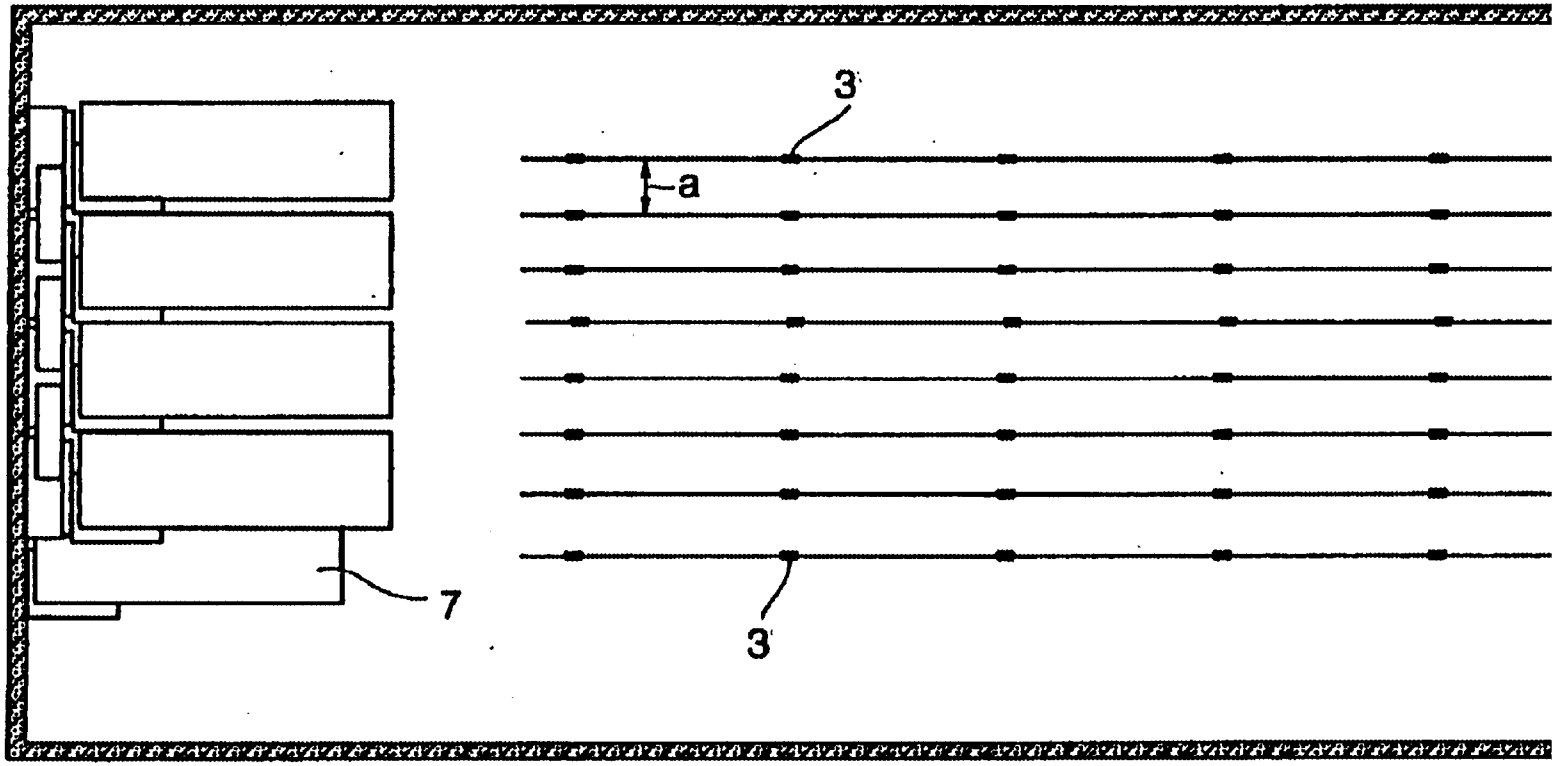
FIG. 2 shows a section through the stage space according to line II—II in FIG. 1.

Referring now in detail to the drawings, FIGS. 1 and 2 show a theatrical stage space in which there are holding girders 1 which are mounted in close proximity to one another, distributed over the entire stage surface, so they are adjustable in height. These holding girders 1 are each suspended on multiple cables 2 distributed over the length of the girders. These cables 2 are each guided over deflection pulleys 3 which are mounted in the area of the upper stage space to yield a horizontal course and then can run to a cable-operating device 5 mounted on a side wall of the stage over additional deflection pulleys 4 mounted in the upper area of this side wall on the whole, a corresponding number of cable-operating devices 5 is allocated to a certain number of holding girders 1. All cables 2 connected to one holding girder 1 run toward a common cable-operating device 5.

Each cable-operating device 5 consists of an electrically operated drive device 6 which is shallow in the axial direction, a cable drum 7 which encompasses the drive device 6 completely around the circumference and almost completely in the axial direction as well as fastening means 8 for fastening to a side wall of the stage. Cable drum 7 is cylindrical in shape.

Figure 3:
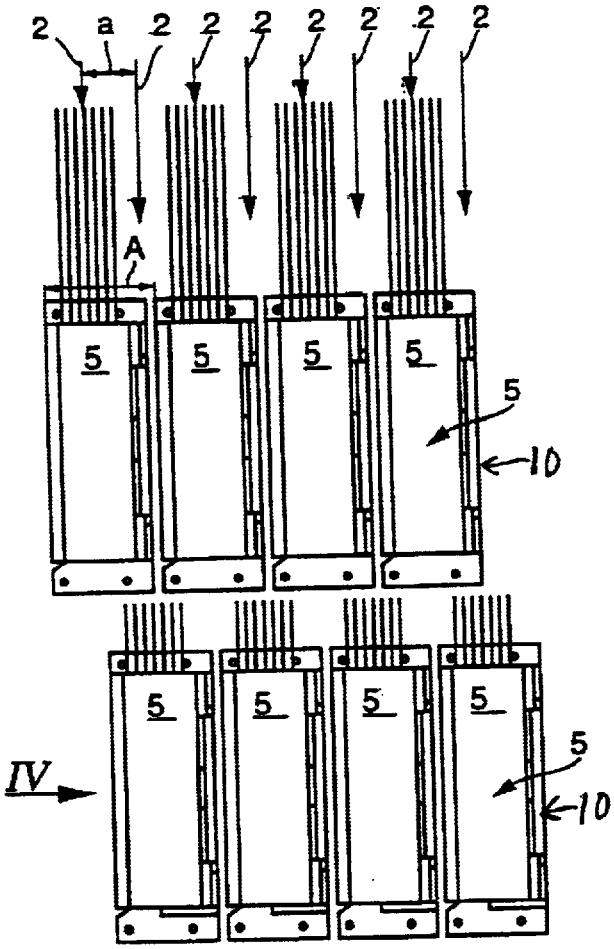
FIG. 3 shows a view of a side wall of the stage space according to the arrow III in FIG. 1.
Figure 4:
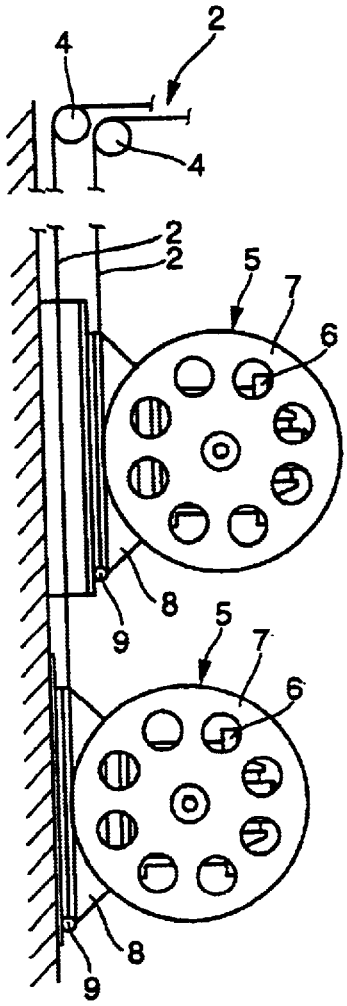
FIG. 4 shows a view in the direction of the arrow IV of the cable-operating devices illustrated in FIG. 3.

The cable-operating devices 5 are mounted on the side wall of the stage in two rows one above the other as shown in FIG. 4 such that the cable-operating devices 5 in the upper row are mounted so they are offset with a gap relative to those in the lower row (see FIG. 3). In addition, the cable-operating devices 5 of the upper row are mounted with a distance from the side wall of the stage with respect to those of the lower row (FIG. 4). Therefore, the cables 2 of the cable-operating devices 5 from the two rows may run in different planes and may partially cover one another with respect to a mutual projection of the cable surfaces.

The horizontal distances a between the holding girders 1 may amount to 200 mm. In this case, the total width A of the cable-operating devices 5 including a distance from an adjacent cable-operating device may amount to 400 mm. At any rate, an extremely small portion projects laterally out of the cable drums 7. The gap between the individual cable-operating devices 5 side by side may be used to permit operation of the mechanical transmission means for operation of a brake 10 (FIG. 3), which is to be operated in the event of an emergency, of the drive device 6 of the cable-operating device 5.

Essentially the drive devices 6 may be equipped with a synchronous motor which is energized by a permanent magnet and which transmits its torque via a gear, in particular a planetary gear, to the cable drum 7.

For maintenance of the cable-operating devices 5, they may be mounted so they are each foldable about a horizontal axis 9 in the direction of the cable. In addition, the cable-operating devices are arranged in at least two rows parallel to each other.

Accordingly, while only a few embodiments of the present invention have been shown and described, it is obvious that many changes and modifications may be made thereunto without departing from the spirit and scope of the invention.

What is claimed is:

1. A cable winch hoisting device for theatrical stages, comprising:

a plurality of elongated, holding girders, said holding girders being adjustable in height between two end positions without mutual hindrance in clearance spaces by cable-operating devices of the same number as that of the holding girders, at least two cables within each cable-operating device each cable being uniformly adjustable by the same cable-operating device, acting together on said holding girder related to said cable-operating device, and distributed over the length of said holding girder, wherein said holding girders are suspended on said cables and are adjustable in height by altering a free cable length between the cable suspension within the cable-operating device and the holding girder, determining the position of the respective holding girder;

an electric driven cable drum within each cable-operating device, wherein said cables acting on one of said holding girders are wound up side by side onto said cable drum of the respective cable-operating device with a same change in free cable length which determines the position of the holding girder, said cable drums being cylindrical in shape and accommodating in their interior almost completely a drive device which is necessary for electric drive and which cable drum is fixed to the electric drive only in the central part of the drum while the edge of the drum does not have any contact with the electric drive, wherein several cable-operating devices are each arranged in a stationary mount side by side horizontally in close proximity, and wherein the cable-operating devices are arranged in at least two rows one above the other, wherein a middle point of two drive devices situated side by side horizontally is allocated to a middle point of a drive device situated in the other row, wherein the cables of the cable-operating devices situated at different planes leave the respective cable drums in different planes which are spanned by the cables of cable-operating devices arranged in a row.

2. A hoisting device according to claim 1, wherein when the horizontal distances a between the holding girders is up to 300 mm, the cable-operating devices have a maximum width A of 600 mm, including a distance from an adjacent device in a same row.

3. The hoisting device according to claim 2, wherein when the distance a between the holding girders is up to 250 mm, a respective width A of the cable-operating devices measures a maximum of 500 mm.

4. The hoisting device according to claim 2, wherein when the distance a between the holding girders is up to 200 mm, a respective width A of the cable-operating devices measures a maximum of 400 mm.

5. The hoisting device according to claim 4, wherein when the distance a between the holding girders is up to 150 mm, the respective width A of the cable-operating devices (5) measures a maximum of 300 mm.

6. The hoisting device according to claim 1, wherein areas taken up by the cables in planes in which said cables overlap run with respect to a mutual perpendicular projection of these areas.

7. The hoisting device according to claim 1, wherein the cable drum is made of plastic.

8. The hoisting device according to claim 1, wherein the drive devices are each equipped with a brake device.

9. The hoisting device according to claim 1, wherein the drive devices of the cable-operating devices each have a synchronous motor which is energized by a permanent magnet as a power source and which acts on a gear.

10. The hoisting device according to claim 9, wherein the gear is a planetary gear.

11. The hoisting device according to claim 1, wherein each drive device is equipped with an integrated, independent frequency regulator.

12. The hoisting device according to claim 1, wherein at least two drive devices are regulated by a single frequency regulator.

13. A cable winch hoisting device for theatrical stages, comprising:

a plurality of elongated, holding girders, said holding girders being adjustable in height between two end positions without mutual hindrance in clearance spaces by cable-operating devices of the same number as that of the holding girders, at least two cables within each cable-operating device each cable being uniformly adjustable by the same cable-operating device, acting together on said holding girder related to said cable-operating device, and distributed over the length of said holding girder, wherein said holding girders are suspended on said cables and are adjustable in height by altering a free cable length between the cable suspension within the cable-operating device and the holding girder, determining the position of the respective holding girder;

an electric driven cable drum within each cable-operating device, wherein said cables acting on one of said holding girders are wound up side by side onto said cable drum of the respective cable-operating device with a same change in free cable length which determines the position of the holding girder, said cable drums being cylindrical in shape and accommodating in their interior almost completely a drive device which is necessary for electric drive and which cable drum is fixed to the electric drive only in the central part of the drum while the edge of the drum does not have any contact with the electric drive, wherein several cable-operating devices are each arranged in a stationary mount side by side horizontally in close proximity, and wherein the cable-operating devices are each foldable about a horizontal axis.

14. A cable winch hoisting device for theatrical stages, comprising;

a plurality of elongated, holding girders, said holding girders being adjustable in height between two end positions without mutual hindrance in clearance spaces by cable-operating devices of the same number as that of the holding girders, at least two cables within each cable-operating device each cable being uniformly adjustable by the same cable-operating device, acting together on said holding girder related to said cable-operating device, and distributed over the length of said holding girder, wherein said holding girders are suspended on said cables and are adjustable in height by altering a free cable length between the cable suspension within the cable-operating device and the holding girder, determining the position of the respective holding girder;

an electric driven cable drum within each cable-operating device, wherein said cables acting on one of said holding girders are wound up side by side onto said cable drum of the respective cable-operating device with a same change in free cable length which determines the position of the holding girder, said cable drums being cylindrical in shape and accommodating in their interior almost completely a drive device which is necessary for electric drive and which cable drum is fixed to the electric drive only in the central part of the drum while the edge of the drum does not have any contact with the electric drive, wherein several cable-operating devices are each arranged in a stationary mount side by side horizontally in close proximity, and wherein the cable-operating devices are arranged in at least two rows parallel to each other, wherein a middle point of two drive devices situated side by side horizontally is allocated to a middle point of a drive device situated in the other row, wherein the cables of the cable-operating devices situated at different planes leave the respective cable drums in different planes which are spanned by the cables of cable-operating devices arranged in a row.

* * * * *